United States Patent [19]

Kidd et al.

[11] Patent Number: 4,974,738

[45] Date of Patent: Dec. 4, 1990

[54] CONTAINER WITH INTERCHANGEABLE COMPONENTS

[75] Inventors: Allen Kidd, Placentia; Dale A. Meyer, Redondo Beach; Robert F. Stamberger, Fullerton; Janet T. Haubold, Manhattan Beach; Henry R. Urciuoli, Brea, all of Calif.

[73] Assignee: Packaging Corporation of America, Evanston, Ill.

[21] Appl. No.: 377,527

[22] Filed: Jul. 10, 1989

[51] Int. Cl.[5] ..... B65D 1/00

[52] U.S. Cl. ..... 220/4 E; 220/4 B; 229/2.5 R

[58] Field of Search ..... 220/4 B, 4 E, 356; 229/2.5 R

[56] References Cited

U.S. PATENT DOCUMENTS

| | | | |
|---|---|---|---|
| Re. 29,415 | 9/1977 | Ricobene et al. | 220/4 E X |
| 2,999,611 | 9/1961 | Paulson | 220/4 E |
| 3,902,540 | 9/1975 | Commisso | 220/4 E X |
| 3,933,295 | 1/1976 | Congleton | 220/4 E X |
| 4,159,062 | 6/1979 | Levenhagen | 220/4 B |
| 4,294,371 | 10/1981 | Davis | 220/4 E |
| 4,360,118 | 11/1982 | Stern | 220/4 E |
| 4,741,452 | 5/1988 | Holzkopf | 220/356 X |

*Primary Examiner*—Steven M. Pollard

*Attorney, Agent, or Firm*—Neuman, Williams, Anderson & Olson

[57] ABSTRACT

A container is provided having a tray component and an independent cover component which is adapted to assume open and close modes with respect to the tray component. The components are interchangeable and each is provided with a recessed center portion having a base delimited by an angularly extending wall. An edge of the wall defines an open side. Each component also includes a laterally extending rim protruding outwardly from the wall edge. A predetermined first portion of the rim is provided with a first lock member and a predetermined second portion of the rim is provided with a second lock member. When the components are in the close mode, the first lock member of the tray component is in interlocking engagement with the second lock member of the cover component and vice versa.

5 Claims, 1 Drawing Sheet

CONTAINER WITH INTERCHANGEABLE COMPONENTS

BACKGROUND OF THE INVENTION

The use of inexpensive, disposable containers for marketing, storing, packaging and serving various types of foods (e.g. salads, bakery items, etc.) has become increasingly popular for both the consumer and the seller. While such containers are widely used, they are nevertheless beset with one or more of the following shortcomings: (a) the container requires several components which are not interchangeable and thus, requires the stocking of several non-interchangeable components; (b) the stocking of several non-interchangeable components frequently requires an inordinate amount of storage space; (c) the container is not readily capable of accommodating a variety of products; (d) the container, when in a close mode, is susceptible to accidentally opening; (e) the container is extremely fragile and provides inadequate protection for the accommodated product; and (f) the container is not microwavable.

SUMMARY OF THE INVENTION

Thus, an improved container is provided which effectively avoids all of the aforenoted shortcomings.

The improved container is of simple, inexpensive, yet sturdy, construction and has an attractive appearance.

The components of the improved container are readily nestable for bulk shipping and/or storage.

When the container components are in a close mode, the accommodated product may be readily observed without requiring the container to be opened.

Further and additional inherent advantages possessed by the improved container will become apparent from the description, accompanying drawings and appended claims.

In accordance with one embodiment of the invention, a container is provided having interchangeable cover and tray components. The components are adapted to interlock with one another, when in a close mode, and to nest with one another, when in an open mode. Each component includes a recessed center portion having a base delimited by an angularly extending wall. The wall has an edge which defines an open side. Extending laterally outwardly from the wall edge is a rim. The rim includes a predetermined first peripheral portion which is provided with a first lock means and a predetermined second peripheral portion which is provided with a second lock means. When the components are in a close mode, the cover component is in an inverted aligned relation with the tray component and the first lock means of each component is in interlocking engagement with the second lock means of the other component. When the container is in an open mode, the cover and tray components are adapted to assume a nested relation.

DESCRIPTION

For a more complete understanding of the invention, reference is made to the drawings wherein.

Figure 1:
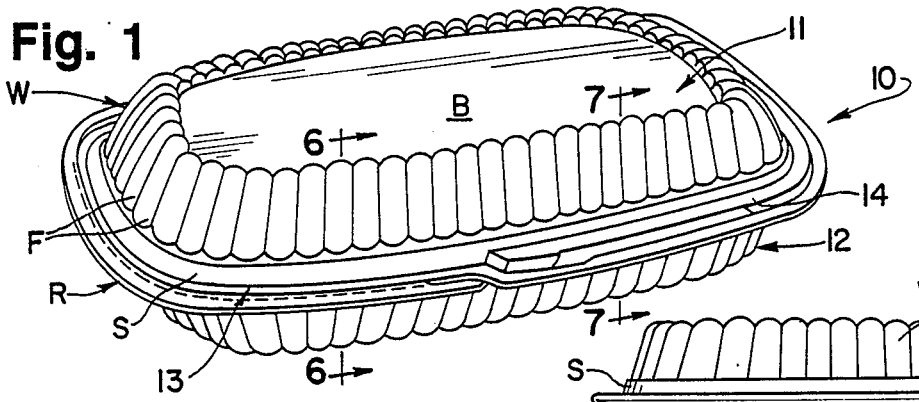
FIG. 1 is a perspective view of one embodiment of the improved container in a close mode.
Figure 4:
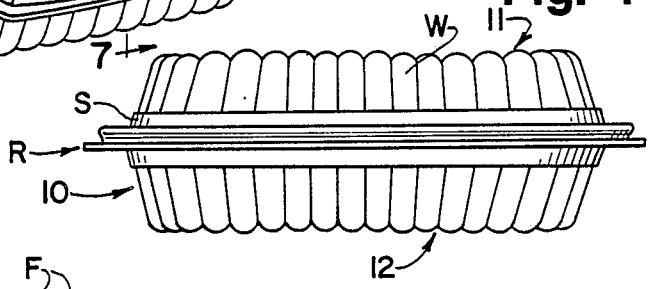
FIGS. 3 and 4 are front and end views, respectively, of the container of FIG. 1.
Figure 6:
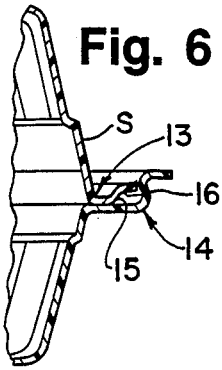
Figure 7:
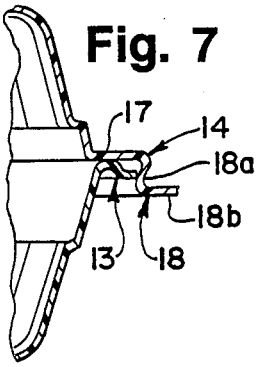

FIGS. 6 and 7 are fragmentary, enlarged sectional views taken respectively along lines 6—6 and 7—7 of FIG. 1.

Figure 2:
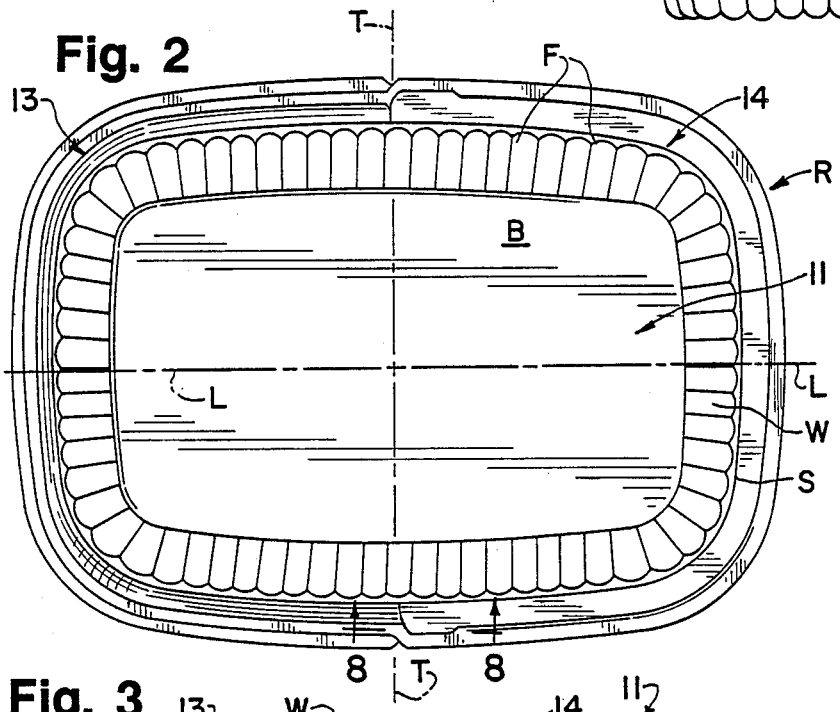
FIG. 2 is an enlarged top plan view of the container of FIG. 1.
Figure 8:
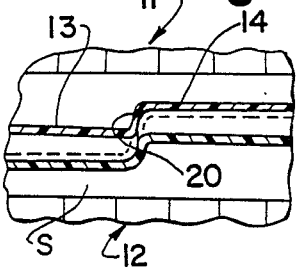

FIG. 8 is a fragmentary, enlarged sectional view taken along line 8—8 of FIG. 2.

Figure 3:
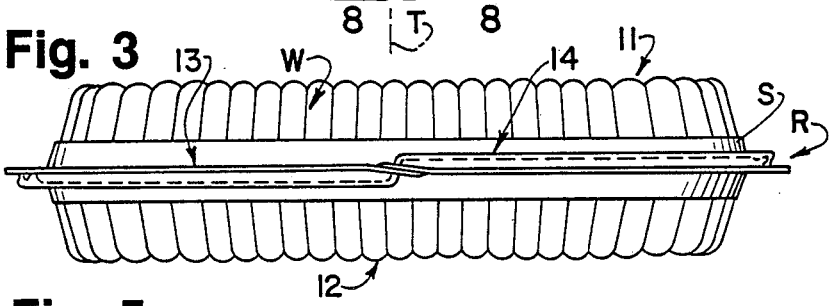
Figure 5:
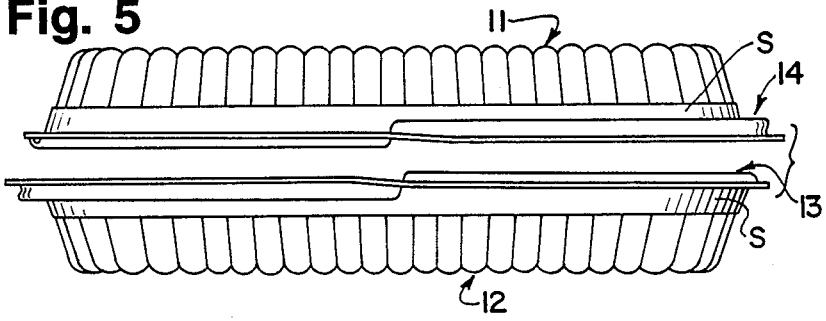
FIG. 5 is similar to FIG. 3 but showing the top component in an inverted aligned spaced relation with the open side of the tray component and just prior to being moved into a close mode therewith.

Referring now to the drawings and more particularly to FIGS. 1–3, a preferred embodiment of the improved container 10 is shown. The container comprises interchangeable cover and tray components 11 and 12. The components may be molded, or thermoformed, from a suitable inexpensive plastic material which is transparent to microwaves. The components are preferably of like configuration and disposable. Each component includes a recessed center portion which embodies a base B delimited by an angularly extending wall W. To provide added rigidity and strength to the wall a plurality of symmetrically arranged flutes are formed therein. The wall tapers outwardly a small amount from the base and the outer edge of the wall defines an open side. As illustrated in the drawings, the wall outer edge is in the form of an outwardly offset shoulder S. The wall flutes F terminate at the shoulder.

Projecting laterally outwardly from the outer edge of the shoulder of each component is a rim R. Formed in a first peripheral segment of the rim is a first lock means or element 13, and in a second peripheral segment is a second lock means or element 14, see FIG. 1. Each component has a longitudinal axis L-L and a transverse axis T-T, see FIG. 2. The first lock means 13 and the second lock means 14 are disposed on opposite sides of the transverse axis T-T. In some instances, however, it might be more desirable to have the first and second lock means disposed on opposite sides of the longitudinal axis. The relative location of the lock means with respect to the axes will depend upon the overall shape of the component.

As seen more clearly in FIGS. 6 and 7, the first lock means 13 includes a hollow rib 15 which is outwardly offset relative to the wall shoulder S. An inner side of the rib 15 is integral with the outer edge of the wall shoulder. The opposite, or outer, side of the rib 15 terminates in a laterally extending outer flange 16. The open side of the hollow rib faces towards a plane defined by the base B of the recessed center portion. As seen in FIG. 2, each lock means 13,14 occupies approximately one-half the circumference of the rim R.

The second lock means 14 includes a lateral ledge 17 which is integral with and extends outwardly from the wall shoulder S, see FIG. 7. The outer edge of ledge 17 is integral with an angularly extending, yieldable lip 18. The lip may include an inner segment **18*a* and an angularly extending outer segment 18*b*. The outer lip segment 18*b* facilitates manual distortion of the lip 18** when the interlocked cover and tray components are to be opened, as will be described more fully hereinafter.

As seen in FIGS. 6 and 7, the inner segment **18*a* of lip 18 is spaced outwardly from the wall shoulder an amount sufficient to resiliently accommodate therebetween the rib and outer flange of the first lock means when the components are in a close mode. The lip 18 is yieldable and thus, when the components are moved into a close mode, the lip 18 will distort outwardly a small amount allowing the first lock means 13 to pass between the wall shoulder S and the lip segment 18*a*** until the rib 15 of the first lock means engages the ledge 17. Because the lip 18 seeks to return to its normal angular position relative to ledge 17, the lip segment 18*a* will resiliently embrace the edge of the outer flange 16 of the first lock means.

When the components are to be interlocked, the cover component 11 is inverted and aligned with the open side of the tray component and the first lock means 13 of the cover component is vertically disposed relative to the second lock means 14 of the tray component and vice versa.

To unlock the closed components, the lip segment 18*b* of the second lock means adjacent one corner of the container tray component is manually distorted outwardly and downwardly with the fingers of one hand while the fingers of the other hand grasp and pull upwardly the adjacent wall sections defining the corresponding corner of the cover component, until the first lock means of the latter is released from the second lock means of the tray component.

Where the container components are formed of a transparent plastic, the contents of the container may be readily observed without requiring removal of the cover components. The shape and size of the container components may vary from that shown and will depend upon the type and size of the product to be disposed within the container. In addition to the container being microwavable it is desirable that it also be capable of withstanding freezing temperatures.

We claim:

1. A closable container comprising a tray component and a cover component independent of said tray component and adapted to assume open and close modes with respect thereto, said components being interchangeable and of substantially like construction; each component including a recessed center portion having a base delimited by an angularly extending wall, the latter having an edge defining an open side, and a laterally extending continuous rim protruding outwardly from said wall edge; said rim including a first lock means formed on a predetermined first peripheral portion thereof and a second lock means formed on a predetermined second peripheral portion of said rim, said first and second lock means of each component cooperating to substantially delimit said open side; the first lock means of one component interlocking with the second lock means the other component when the components are in the close mode and the cover component is in an overlying inverted relation with the tray component and the first and second lock means of the cover component are in opposed alignment with the second and first lock means respectively of the tray component whereby interlocking of the components occurs substantially throughout the rim thereof.

2. The container of claim 1 wherein when in an open mode, the components are adapted to assume a nested relation and the first and second lock means of one component are in alignment with corresponding first and second lock means of the other component nested therewith.

3. The container of claim 1 wherein said component has a longitudinal axis and a transverse axis, said axes being in a substantially common plane; the first and second lock means each component being separated by one of said axes.

4. The container of claim 1 wherein the first lock means includes an outwardly disposed rib having an inner edge integral with a first segment of the wall edge and an outwardly spaced outer flange; the second lock means having a laterally disposed ledge extending outwardly from an integral with a second segment of the wall edge and an outer lip integral with an yieldably extending angularly from an outer edge of said ledge; when said components are in a close mode, the rib of the first lock means of each component engages the ledge of the second lock means of the other component and the outer lip of the second lock means of each component yieldably embraces the outer flange of the first lock means of the other component; the outer flange of the first lock means and the outer lip of the second lock means of each component are disposed in substantially planar relation.

5. The container of claim 1 wherein each component wall is tapered and provided with a plurality of elongate flutes extending from the periphery of the base towards the open side.

* * * * *

UNITED STATES PATENT AND TRADEMARK OFFICE

CERTIFICATE OF CORRECTION

PATENT NO. : 4,974,738

DATED : December 4, 1990

INVENTOR(S) : Allen Kidd, et al

It is certified that error appears in the above-identified patent and that said Letters Patent is hereby corrected as shown below:

Column 4, line 17, "said" should be --each-- line 27, "an" should be --and-- line 28, "an" (second occurrence) should be --and--.

Signed and Sealed this

Twenty-ninth Day of September, 1992

*Attest:*

DOUGLAS B. COMER

*Attesting Officer*

*Acting Commissioner of Patents and Trademarks*